United States Patent [19]

Bodine

[11] Patent Number: 4,736,794

[45] Date of Patent: Apr. 12, 1988

[54] METHOD FOR THE SONIC CEMENTING OF DOWN HOLE WELL CASINGS

[76] Inventor: Albert G. Bodine, 7877 Woodley Ave., Van Nuys, Calif. 91403

[21] Appl. No.: 17,169

[22] Filed: Feb. 20, 1987

Related U.S. Application Data

[63] Continuation-in-part of Ser. No. 830,731, Feb. 19, 1986, Pat. No. 4,653,587.

[51] Int. Cl.[4] ..... E21B 33/14

[52] U.S. Cl. ..... 166/286; 166/177

[58] Field of Search ..... 166/177, 249, 285, 286, 166/290

[56] References Cited

U.S. PATENT DOCUMENTS

| | | | |
|---|---|---|---|
| 2,156,207 | 4/1939 | Terrill | 166/290 X |
| 4,393,932 | 7/1983 | Bodine | 166/249 |
| 4,429,743 | 2/1984 | Bodine | 166/177 |
| 4,512,401 | 4/1985 | Bodine | 166/286 X |
| 4,640,360 | 2/1987 | Bodine et al. | 166/286 |
| 4,653,587 | 3/1987 | Bodine | 166/286 |

*Primary Examiner*—James A. Leppink
*Assistant Examiner*—David J. Bagnell
*Attorney, Agent, or Firm*—Edward A. Sokolski

[57] ABSTRACT

A pipe string is suspended from the surface within a well casing installed in a well. The pipe string is centered within the casing and free from connection therewith except at a down hole point in the casing near the bottom thereof whereat the pipe is attached to the casing. Cement is flowed down the pipe string and out the bottom end thereof from where it flows up along the outer wall of the casing to form a cement annulus therearound. While the cement is being flowed, sonic energy is fed to the pipe string from a sonic oscillator attached thereto. The sonic energy travels down the pipe string and is fed to the bottom of the casing and operates to assure that the cement fills the area around the casing in a uniform manner, at the same time effecting the release of gas bubbles, dirt, rust, scale and other particles from the casing surface to facilitate the formation of a good bond between the cement and the casing wall.

2 Claims, 1 Drawing Sheet

METHOD FOR THE SONIC CEMENTING OF DOWN HOLE WELL CASINGS

Figure 1A:
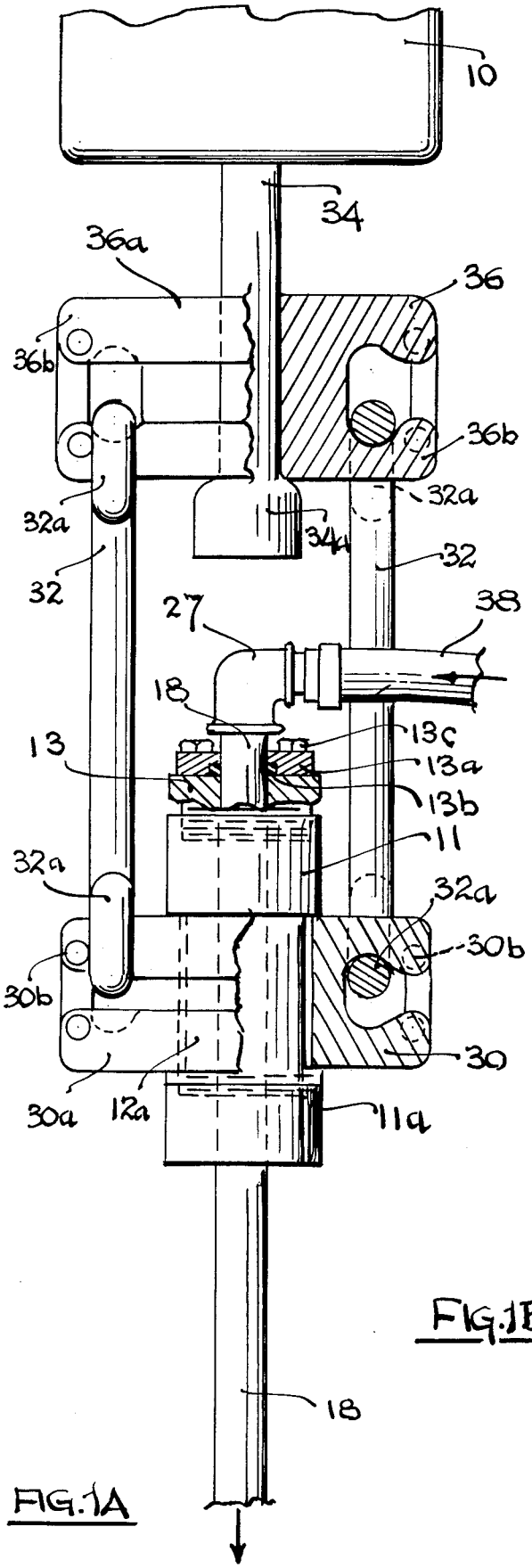

This application is a continuation-in-part of my application Ser. No. 830,731 filed Feb. 19, 1986 now U.S. Pat. No. 4,653,587.

This invention relates to the servicing of oil wells to form a cement annulus around the casings thereof and more particularly to an improved method for facilitating the efficient transmission of sonic energy to a casing section at a down hole location.

In the finishing of deep oil wells, it is standard practice to place a steel casing in the well bore which generally includes sections threadably joined together and lowered into the well immediately after it is drilled. Such a casing is useful in preventing side wall caving and in providing a strong retainer which keeps the well open during subsequent mechanical operations. After such a casing has been installed, concrete is often poured therein and allowed to rise up along the outer casing walls to form a sealing annulus therearound. Methods for forming such a cementitious annulus around a casing in which sonic energy is employed to fluidize the particles of cement and mud are described in my application Ser. No. 830,731, U.S. Pat. No. 4,653,587 of which the present application is a continuation-in-part and in my U.S. Pat. No. 4,512,401. The use of sonic energy as described in the aforementioned patent application and patent assures that the cement fills the area around the casing in a uniform manner and at the same time effects the release of gas bubbles, dirt, rust, scale and other particles from the casing surface so as to enable the formation of a highly effective sealing bond between the cement column and the casing wall.

In the systems of the aforementioned patent application and patent, the sonic energy is transmitted to the bottom of the well from the surface along the entire casing string. Particularly in the case of very deep wells, this results in considerable sonic energy loss along the casing in view of its engagement with the surrounding earthen material which causes frictional dissipation of the energy.

The method of the present invention overcomes the aforementioned shortcomings by providing means for transmitting the sonic energy through the pipe string which is used to feed the cement to the bottom of the well. This pipe string is suspended from the surface within the casing string and attached to the casing to transmit sonic energy thereto only at its lower end and at a point near the bottom of the casing. The pipe string carrying the sonic energy is thus kept free from tight engagement the casing string except at its down hole point of attachment. In this manner, the sonic energy is transmitted through the freely suspended pipe string to the casing at a down hole location in the vicinity of the work area.

It is therefore an object of this invention to improve the efficiency of transmitting sonic energy to a down hole point on a casing string to facilitate the installation of a cementitious annulus around the outer wall of the casing.

Figure 1B:
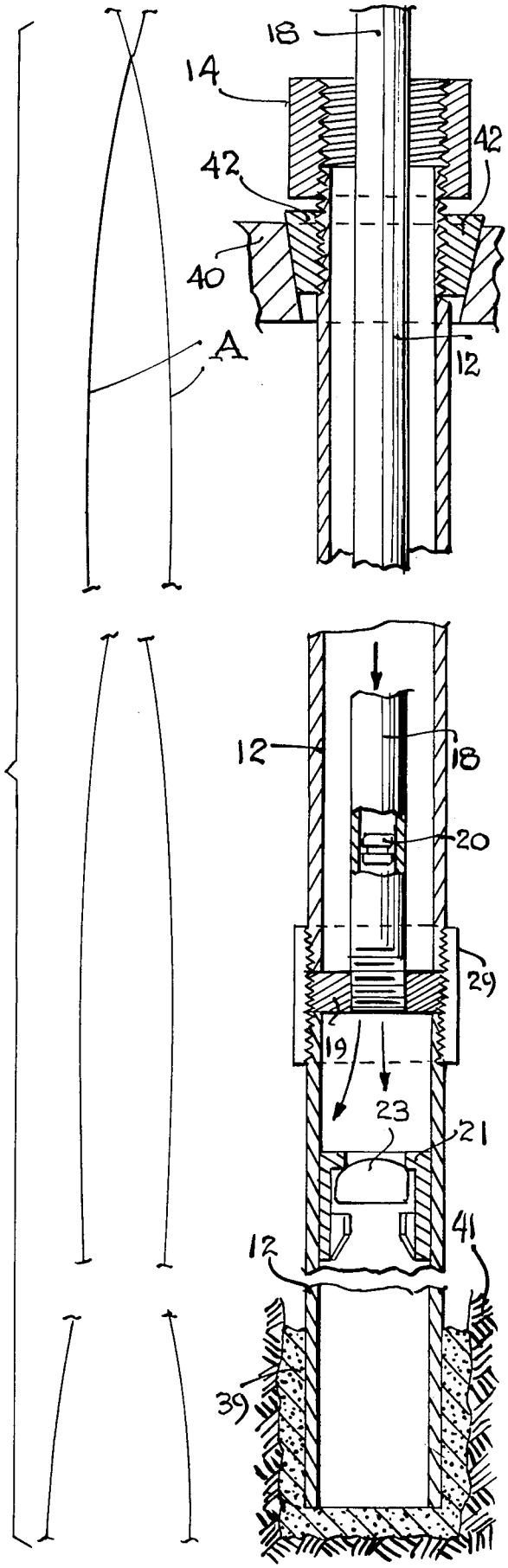

Other objects of the invention will become apparent as the description proceeds in connection with the accompanying drawings of which:

FIGS. 1A and 1B illustrate an embodiment of the invention.

Except for the method for transmitting sonic energy from the surface along the pipe string rather than along the casing, and the suspension of the pipe string within the casing, the method of the present invention is generally the same as that described in my application Ser. No. 831,731, U.S. Pat. No. 4,653,587, the disclosure of which is incorporated herein by reference.

Referring now to FIGS. 1A and 1B, an embodiment of the invention is illustrated. Sonic oscillator 10 may be of the type described in my U.S. Pat. No. 4,429,743 issued Feb. 9, 1984 which is capable of providing vibrational energy to pipe string 18 in a longitudinal vibrational mode. If so desired, the oscillator assembly may additionally include a second oscillator for providing sonic energy to the pipe string in a lateral vibrational mode such as described in my U.S. Pat. No. 4,403,665 or may include such a lateral oscillator in lieu of a longitudinal mode oscillator. Oscillator assembly 10 has a shaft 34 fixedly attached therein as for example by standard thread connection, the shaft having an upset portion **34*a* at the extreme lower end thereof. Shaft 34 is fitted through an aperture formed in holder 36 which may be a commercially available side door elevator with a side door portion 36*a* which can be opened to receive shaft 34, this side door being closable with a safety latch 36*b* to insure proper holding action. A second such holder or elevator member 30 is provided, this holder member being fitted between collars 11 and 11*a* which are threadably attached to the opposite ends of casing section 12*a*. Link members 32 have eye portions 32*a* on the opposite ends thereof, these eye portions being fitted in the opposite apertured ends 36*b* and 30*b* of holders 36 and 30** respectively.

Pipe string 18 which is fabricated of an elastic material such as steel is centered within and attached to collar 11 by means of bushing 13 which is threadably attached to the collar. Clamp ring **13*a* is bolted to bushing 13 by means of bolts 13*c* and clamps O-ring 13*b* against pipe string 18 to form a gripping annulus although elbow 27 may also engage the top of clamp ring 13*a*. The pipe string 18 is thus suspended from oscillator 10 in tight engagement therewith, the top edge of holder member 30 abutting against collar 11 and the top edge of bulb portion 34*a* of shaft 34 abutting against the bottom edge of holder 36, thereby providing tight acoustic coupling to the pipe string for the sonic energy generated by oscillator 10. A flexible hose 38 is coupled to the top end of pipe string 18 by means of threaded coupler 27**.

Casing string 12 which is fabricated of an elastic material such as steel, is suspended from above the surface on conventional rotary table 40 by means of tapered circular slip member 42 which threadably engages the top end of the casing. A collar 14 is provided at the top end of the casing in threadable engagement therewith.

Circular bulkhead bushing 19 is threadably attached to clamp ring 29 which threadably joins adjoining sections of casing 12 together in a down hole region. The bottom end of pipe string 18 is threadably attached to bushing 19 thereby providing a transmission path to the lower portions of casing 12 for the sonic energy traveling down pipe string 18. A wiper plug 20 may be provided for use in purging pipe string 18 of cement after the operation has been completed in the same manner as described in my aforementioned U.S. Pat. No. 4,512,401. A float shoe 21 is installed in casing 11. This float shoe has a check valve 23 to prevent back flow of cement if the pressure is released in pipe string 18 or if pipe string 18 is unscrewed from its threaded engagement with bushing 19 and lifted up for cleaning.

In carrying out the method of the invention, sonic energy is provided in a continuous manner from oscillator 10 through the coupling to pipe string 18. This energy is preferably at a frequency such as to set up a resonant standing wave vibration of the pipe string as indicated by graph lines A. Cement is introduced into pipe string 18 from hose 38. This cement flows down the pipe string and out the bottom end thereof through valve 23 to the bottom of casing 12 and out along the sides thereof to form a cement annulus 39 which rises up between the outer walls of the casing and earthen formation 41. It is to be noted that at this time, plug 20 is not installed in the pipe. This process is continued until the cement annulus 39 has risen to the desired level. Pipe 18 is then cleaned by means of wiper member 20 which is inserted at the top end of the pipe by removing coupler 27 and feeding water into the pipe string 18 to drive the wiper down the pipe and out through the bottom thereof. This further quantity of flushed out cement may be used to drive the annulus flow 39 to a somewhat higher level. Bushing 19 and valve assembly 23 may later be drilled out of the casing.

While the invention has been described and illustrated in detail, it is to be clearly understood that this intended by way of illustration and example only and is not to be taken by way of limitation, the spirit and scope of the invention being limited only by the terms of the following claims.

I claim:

1. A method for forming a cementitous annulus around the outer wall of a well casing comprising the steps of:

suspending said casing in a well bore from first support means located at a position above said bore;

suspending a pipe string from second support means located at a position above said bore, said pipe string being suspended within said casing, said pipe string being attached to said casing at a down hole point thereon near the lower end thereof, said pipe string being free of said casing except at the point of attachment thereto;

flowing cement down said pipe string and out the bottom end of the casing such that the cement rises up along the casing to form an annulus therearound;

while the cement is being so cast, transmitting sonic energy along the pipe string to said casing by means of an oscillator coupled to said pipe string, the frequency of the oscillator being adjusted to cause elastic vibration of said casing so as to release gas bubbles, dirt and other foreign matter from the casing surface thereby to wet said surface with the cement to effect a sealing bond between the cement and the casing.

2. The method of claim 1 wherein said oscillator is coupled to said pipe string by suspending said pipe string from said oscillator.

* * * * *